US009599101B2

(12) United States Patent
Lefevre et al.

(10) Patent No.: US 9,599,101 B2
(45) Date of Patent: Mar. 21, 2017

(54) CRYOGENIC PUMPS

(71) Applicant: Westport Power Inc., Vancouver (CA)

(72) Inventors: Alexis Lefevre, Uffheim (FR); Pierre Papirer, Reiningue (FR)

(73) Assignee: WESTPORT POWER INC., Vancouver (CA)

( * ) Notice: Subject to any disclaimer, the term of this patent is extended or adjusted under 35 U.S.C. 154(b) by 235 days.

(21) Appl. No.: 14/142,800

(22) Filed: Dec. 28, 2013

(65) Prior Publication Data

US 2014/0109599 A1 Apr. 24, 2014

Related U.S. Application Data

(63) Continuation of application No. PCT/CA2012/050415, filed on Jun. 22, 2012.

(30) Foreign Application Priority Data

Jun. 29, 2011 (EP) ..... 11352007

(51) Int. Cl.
*F17C 9/02* (2006.01)
*F04B 15/08* (2006.01)
*F04B 37/06* (2006.01)

(52) U.S. Cl.
CPC ..... *F04B 15/08* (2013.01); *F04B 37/06* (2013.01)

(58) Field of Classification Search
CPC ..... F04B 37/06; F04B 15/08; F17C 9/02
USPC ..... 62/50.2, 50.6, 50.1
See application file for complete search history.

(56) References Cited

U.S. PATENT DOCUMENTS

| | | | | |
|---|---|---|---|---|
| 2,964,917 | A | 12/1960 | Webster | |
| 3,875,759 | A * | 4/1975 | Malcosky | F28D 7/022 165/156 |
| 5,819,544 | A | 10/1998 | Andonian | |
| 5,884,488 | A | 3/1999 | Gram et al. | |
| 5,971,727 | A | 10/1999 | Horan et al. | |
| 7,293,418 | B2 | 11/2007 | Noble et al. | |
| 2007/0214806 | A1 | 9/2007 | Faka | |

OTHER PUBLICATIONS

European Search Report issued on Nov. 11, 2011, in connection with European Patent Application No. 11352007.6.

(Continued)

*Primary Examiner* — Len Tran
*Assistant Examiner* — Ana Vazquez
(74) *Attorney, Agent, or Firm* — Carie C. Mager; C. Larry Kyle

(57) ABSTRACT

A cryogenic pump has an associated heater for vaporizing cryogenic fluid. The heater has a chamber (bounded by an inner sleeve and an outer sleeve) disposed around at least a portion of the pump housing. The heater has a helical heating coil with a plurality of turns disposed within the chamber and a helical baffle having a plurality of turns interspaced with the turns of the heating coil for guiding heat exchange fluid over the turns of the heat exchange coil. The heater has an inlet for cryogenic fluid to communicate with the heat exchange coil and an outlet for the resulting vaporized fluid. Heat exchange fluid flows through an inlet of the heater chamber to an outlet of the heater chamber and then through a space defined between the inner sleeve and a portion of the pump housing.

9 Claims, 4 Drawing Sheets

(56) References Cited

OTHER PUBLICATIONS

International Search Report and Written Opinion of the International Searching Authority issued on Aug. 1, 2012, in connection with PCT/CA2012/050415.
International Preliminary Report on Patentability issued on Jan. 16, 2014, in connection with International Application No. PCT/CA2012/050415.

* cited by examiner

CRYOGENIC PUMPS

CROSS-REFERENCE TO RELATED APPLICATIONS

This application is a continuation of International Application No. PCT/CA2012/050415 having an international filing date of Jun. 22, 2012 entitled "Cryogenic Pumps". The '415 international application claimed priority benefits, in turn, from European Patent Application No. 11352007.6 filed on Jun. 29, 2011. The '415 international application is hereby incorporated by reference herein in its entirety.

FIELD OF THE INVENTION

The present invention relates to a cryogenic pump and particularly to a heater for use with a cryogenic piston pump.

BACKGROUND OF THE INVENTION

Cryogenic pumps are typically used in industrial plants for example, in plant for the separation or liquefaction of industrial gases. Cryogenic liquefied gases are becoming increasingly widely used. For example, liquefied natural gas (LNG) is now being used as an automotive fuel, particularly for heavy goods vehicles (HGVs). Piston pumps have been developed in order to transfer the LNG from a storage vessel on board the vehicle to the vehicle's engine. Such pumps need to be quite compact, easy to maintain and to produce vaporized LNG at a high pressure (typically 300 bar).

An example of a cryogenic pump suitable for use with LNG on an HGV is given in U.S. Pat. No. 7,293,418.

SUMMARY OF THE INVENTION

An improved cryogenic pump for pumping a cryogenic liquid natural gas having associated therewith a heater for vaporizing the cryogenic liquid. The heater comprises:

(a) a chamber bounded by an inner sleeve and an outer sleeve;

(b) a helical heat exchange coil having a plurality of turns disposed within the heater chamber;

(c) an inlet with cryogenic liquid communicating with the heat exchange coil;

(d) an outlet for resulting vaporized fluid communicating with the heat exchange coil;

(e) an inlet to the heater chamber for a heat exchange fluid; and (f) an outlet from the heater chamber for the heat exchange fluid.

The heater chamber comprises a helical baffle comprising a plurality of turns for guiding the heat exchange fluid over the turns of the heat exchange coil. The turns of the baffle are interspaced with the turns of the heat exchange coil.

In one embodiment of the cryogenic pump, the baffle is integral with the inner sleeve or the outer sleeve.

In another embodiment, the cryogenic pump further comprises a piston operable to discharge cryogenic liquid from a pumping chamber within a pump housing. The pump housing is preferably of generally elongate, cylindrical configuration. The chamber is preferably disposed about the pump housing.

In another embodiment, the pumping chamber has an outlet port communicating with one end of the conduit for conducting the cryogenic liquid to the heat exchange coil. The other end of the conduit communicates with the inlet to the heat exchange coil.

In another embodiment, the heat exchange coil is provided with at least one of external ribs, internal ribs and fins to facilitate heat exchange.

In another embodiment, the outlet from the heater chamber for the heat exchange fluid is formed in the inner sleeve.

The terms "vaporized", "vaporization" and "vaporize" all refer to the heating of a cryogenic liquid from below to above its critical temperature. In operation of a cryogenic pump according to the invention, a pumping chamber receives a cryogenic liquid and pumps it typically at a pressure above its critical pressure to a vaporizer. The cryogenic liquid typically enters the vaporizer at a pressure above its critical pressure, is heated in the vaporizer from a temperature below its critical temperature to above its critical temperature, and leaves the vaporizer as a supercritical fluid.

The arrangement of the baffle facilitates heat exchange between the cryogenic liquid and the heat exchange fluid.

BRIEF DESCRIPTION OF THE DRAWINGS

A cryogenic pump according to the invention will now be described by way of example with reference to the accompanying drawings in which.

Figure 1:
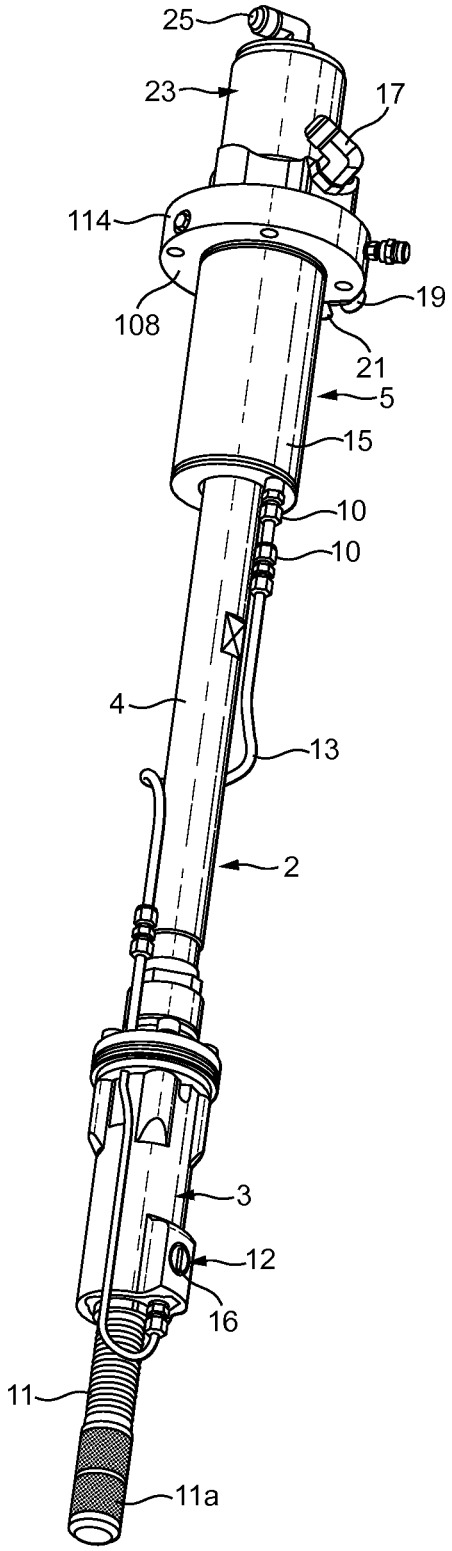
FIG. 1 is a schematic perspective view of the pump.

The drawings are not to scale.

DETAILED DESCRIPTION OF PREFERRED EMBODIMENT(S)

Referring to the drawings, there is shown generally a cryogenic pump 2 of the kind having a cold end 3 adapted to be immersed in a volume of cryogenic liquid, not shown, to be supplied to, for example, a combustion engine. Pump 2 is generally of the same kind as that disclosed in U.S. Pat. No. 7,293,418, except that it does not include an accumulator. Instead, pump 2 has a pumping chamber communicating directly with a vaporizer or like heater. The disclosure of U.S. Pat. No. 7,293,418 is hereby incorporated herein by reference in its entirety.

The cryogenic pump has a warm end 5 opposite a cold end 3. Warm end 5 is not intended for immersion in the cryogenic liquid. Pump 2 has a housing 4 of generally elongate configuration with an axial piston 6 and piston shaft 7. Piston 6 is able, in operation, to draw cryogenic liquid into, and force cryogenic liquid out of, a pumping chamber 8 defined within housing 4. Pumping chamber 8 has an inlet 9 for cryogenic liquid communicating with a hollow cylindrical cryogenic liquid intake member 11 typically fitted with a filter 11*a* effective to prevent small solid particles from entering the pump.

Outlet port 10 houses a check valve 12. Outlet port 10 is connected to a relatively small diameter conduit 13 which extends from cold end 3 to warm end 5 of the pump. Conduit 13 terminates in an annular heater or heat exchange device 15, in which the cryogenic liquid is vaporized by indirect heat exchange with a relatively high temperature heat exchange fluid. If, for example, the cryogenic liquid is LNG and pump 2 is intended to supply the natural gas to an engine (not shown), the heat exchange fluid can be an aqueous fluid that is used to cool the engine. Typically, cryogenic pump 2 raises the pressure of the cryogenic liquid to above its critical pressure, so that strictly speaking it becomes a supercritical fluid rather than a liquid in heater 15. Heater 15 is provided with an outlet 99 (see FIG. 2) for vaporized natural gas and with an inlet 19 and outlet 21 for the heat exchange fluid. As will be described with reference to FIGS. 2, 4 and 5 below, there is within heater 15 a passage for the cold supercritical fluid in heat exchange relationship with another passage for heat exchange fluid. Flow of the cold supercritical fluid through its passage causes its temperature to rise typically to above −20° C.

At warm end 5 of pump 2, there is provided a drive chamber 23 for piston 6. Typically, a hydraulic drive is employed with there being an inlet port 25 and an outlet port 17 for hydraulic fluid, but an electrical, pneumatic, or mechanical drive could alternatively be used. The drive arrangements can in general be similar to those disclosed in U.S. Pat. No. 7,293,418 for the pump described and shown therein. Piston 6 has two strokes. In its upward stroke (that is, in its stroke away from cold end 3, a flow of cryogenic liquid through inlet 9 is induced. In its downward stroke (that is its stroke away from warm end 5) a flow of cryogenic liquid through the outlet port is provided. Pump 2 is capable of generating a high delivery pressure typically in the order of 300 bar or higher. In one example, pump 2 delivers cryogenic liquid at a pressure of 320 bar and a temperature of −162° C., the cryogenic liquid being LNG.

Figure 2:
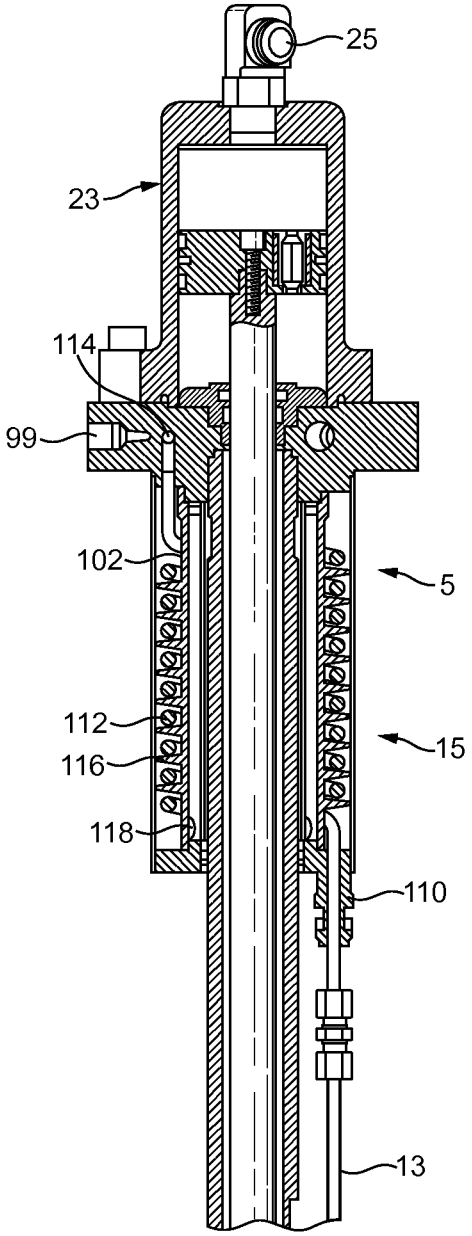
FIG. 2 is a sectional side elevation of the warm end of the pump shown in FIG. 1.
Figure 3:
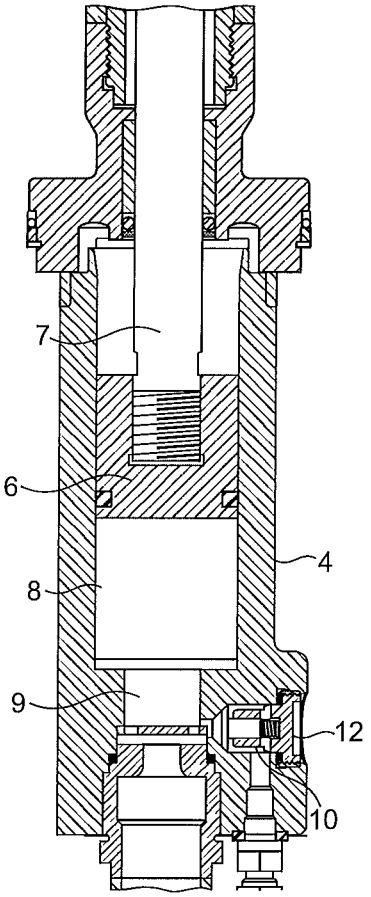
FIG. 3 is a sectional elevation of the pumping chamber of the pump shown in FIG. 1.
Figure 4:
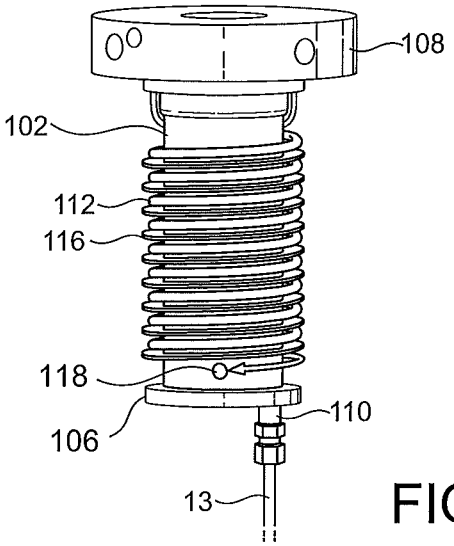
FIG. 4 is a schematic perspective view of the arrangement of the inner sleeve, heat exchange coil and baffle of the heater of the cryogenic pump shown in FIG. 1.
Figure 5:
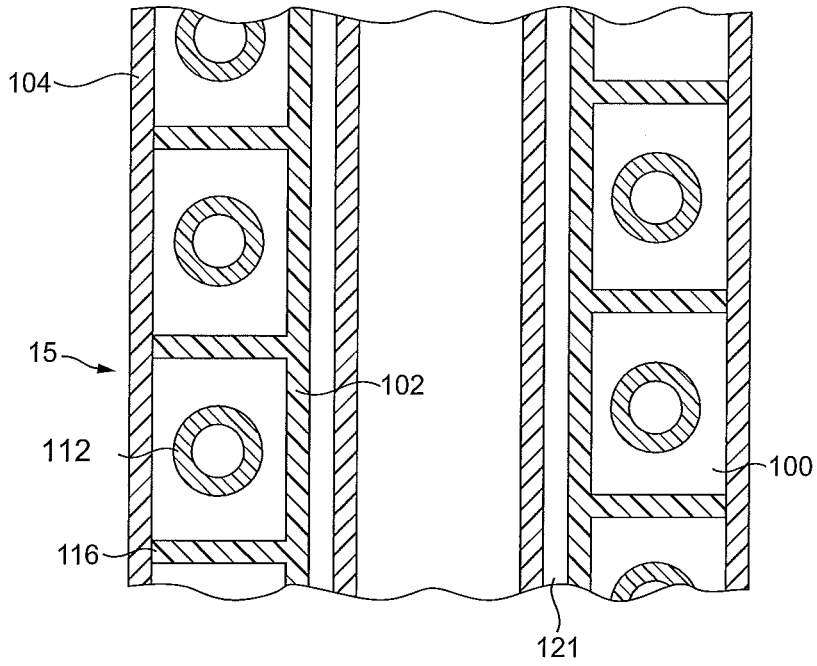
FIG. 5 is a schematic sectional elevation of a central portion of the heater shown in FIGS. 1, 2 and 4, but with all items internal to the housing of the pump being omitted for purposes of clarity of illustration.

The configuration of heater 15 is shown in more detail in FIGS. 2, 4 and 5. Heat exchange chamber 100 is bounded by an inner sleeve 102, an outer sleeve 104, a first flange 106, and a second flange 108. Conduit 13 terminates in an inlet port 110 formed in first flange 106. Inlet port 110 is connected to a helical heating or heat exchange coil 112 located in heat exchange chamber 100. In operation, cryogenic supercritical fluid (typically supercritical natural gas) enters helical coil 112 from port 110 and is progressively warmed as it flows around the turns of coil 112. The end of coil 112 remote from port 110 communicates with outlet port 99 (shown in FIG. 2). Natural gas typically leaves port 99 at a temperature of −20° C. and a pressure of above 300 bar. Heat exchange coil 112 can be provided with internal or external fins or ribs (not shown) so as to facilitate heat exchange.

Heater 15 is provided with a distribution chamber 114, bounded in part by second flange 108, for a heating fluid, typically an aqueous liquid employed in the cooling of an internal combustion engine to which the natural gas is supplied as a fuel. Distribution chamber 114 has an inlet port 19 (see FIG. 1) for the heating liquid. Inner sleeve 102 is provided with an integral helical baffle 116. The turns of baffle 116 are interspaced with the turns of coil 112. The turns of baffle 116 engage the inner surface of outer sleeve 104. Accordingly, heating liquid admitted to chamber 100 is caused to flow along a helical path over the turns of coil 112, flowing counter-currently to the supercritical fluid admitted to heating coil 112. The arrangement of baffle 116 thus enhances heat exchange between the heating liquid and the high pressure fluid flowing through coil 112. In the example of the vaporization of the LNG at a pressure of 300 bar or higher, with the heating fluid being an aqueous coolant from an engine to which the natural gas is supplied as fuel, it is possible to achieve a gas discharge temperature in the range of 25-75° C. when the inlet temperature of the heating liquid is 100° C. and the engine is performing from 800-1600 rpm.

The heating liquid is discharged from chamber 100 through apertures 118 into an annular space 121 defined between inner sleeve 102 and a portion of pump housing 4. The heating liquid can be withdrawn from this space via port 21 with the assistance of a water pump (not shown) which is associated with the engine (not shown) to which the natural gas is supplied as fuel.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A cryogenic pump for pumping a cryogenic fluid has associated therewith a heater for vaporizing the cryogenic fluid, the heater comprising:

(a) a heater chamber bounded by an inner sleeve and an outer sleeve and disposed around at least a portion of a pump housing enclosing a piston shaft;

(b) a helical heat exchange coil having a plurality of turns disposed within said heater chamber;

(c) an inlet with cryogenic fluid communicating with said heat exchange coil;

(d) an outlet for resulting vaporized fluid communicating with said heat exchange coil;

(e) an inlet to said heater chamber for a heat exchange fluid; and (f) an outlet from said heater chamber for said heat exchange fluid to flow out from said heater chamber to a space defined between said inner sleeve and said portion of said pump housing;

wherein said heater chamber has a helical baffle having a plurality of turns for guiding said heat exchange fluid over said turns of said heat exchange coil, said turns of said baffle being interspaced with said turns of said heat exchange coil.

2. The cryogenic pump of claim 1, wherein said baffle is integral with said inner sleeve or said outer sleeve.

3. The cryogenic pump of claim 1, further comprising a piston operable to discharge cryogenic fluid from a pumping chamber within said pump housing.

4. The cryogenic pump of claim 3, wherein said pump housing is of generally elongate, cylindrical configuration.

5. The cryogenic pump of claim 3, wherein said pumping chamber has an outlet port communicating with one end of a conduit for conducting said cryogenic fluid to said heat exchange coil, the other end of said conduit communicating with said inlet to said heat exchange coil.

6. The cryogenic pump of claim 1, wherein said heat exchange coil is provided with at least one of external ribs, internal ribs and fins to facilitate heat exchange.

7. The cryogenic pump of claim 1, wherein said outlet from said heater chamber for said heat exchange fluid is formed in said inner sleeve.

8. The cryogenic pump of claim 7, wherein said outlet from said heater chamber for said heat exchange fluid is an aperture.

9. The cryogenic pump of claim 1, further comprising an outlet to said heater located proximate said inlet to said heater chamber for withdrawing said heat exchange fluid from said space.

* * * * *